US011313338B1

(12) United States Patent
Marrack et al.

(10) Patent No.: US 11,313,338 B1
(45) Date of Patent: Apr. 26, 2022

(54) METHOD AND SYSTEM FOR MONITORING INJECTOR VALVES

(71) Applicant: Caterpillar Inc., Peoria, IL (US)

(72) Inventors: Andrew O. Marrack, Peoria, IL (US); Daniel R. Puckett, Peoria, IL (US); Kranti K. Nellutla, Dunlap, IL (US); Dustin K. Fee, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/953,900

(22) Filed: Nov. 20, 2020

(51) Int. Cl.

| | |
|---|---|
| ***F02M 61/04*** | (2006.01) |
| ***F02M 51/06*** | (2006.01) |
| *F02D 41/34* | (2006.01) |
| *F02D 41/20* | (2006.01) |

(52) U.S. Cl.
CPC ..... *F02M 61/04* (2013.01); *F02M 51/06* (2013.01); *F02D 41/345* (2013.01); *F02D 2041/2041* (2013.01); *F02D 2041/2055* (2013.01); *F02D 2041/2058* (2013.01)

(58) Field of Classification Search
None
See application file for complete search history.

(56) References Cited

U.S. PATENT DOCUMENTS 5,650,909 A * 7/1997 Remele ..... F02D 41/20 361/154
5,678,521 A * 10/1997 Thompson ..... F02M 63/00 123/446
5,915,624 A * 6/1999 Coldren ..... F02M 57/02 239/96
5,984,210 A * 11/1999 Forck ..... F02M 63/0031 239/585.1
5,986,871 A 11/1999 Forck et al.
5,995,356 A * 11/1999 Glavmo ..... F02D 41/20 361/154
6,167,869 B1 * 1/2001 Martin ..... F02M 57/023 123/458
6,792,921 B2 * 9/2004 Forck ..... F02M 47/027 123/494
7,013,876 B1 * 3/2006 Puckett ..... F02D 41/20 123/490
7,634,981 B2 * 12/2009 Dea ..... F02D 13/0246 123/90.15
9,714,626 B2 * 7/2017 Hatanaka ..... F02M 63/0017
10,041,461 B2 * 8/2018 Rezaei ..... F16K 37/0041
(Continued)

*Primary Examiner* — Kevin R Steckbauer
(74) *Attorney, Agent, or Firm* — Bookoff McAndrews PLLC

(57) ABSTRACT

A method for controlling a fuel injector includes applying a spill valve current, applying a control valve current, the control and spill valves including components in electrical communication with each other, and detecting a timing at which the spill valve returns to an open position based on induced spill valve current. The method includes detecting a timing at which the control valve returns to a resting position based on induced control valve current, the induced spill valve current and the induced control valve current being included in respective freewheeling currents that at least partially overlap each other, adjusting a spill valve current that is applied during an injection, based on the detected spill valve return timing, and adjusting a control valve current that is applied during the injection, based on the detected control valve return timing.

20 Claims, 5 Drawing Sheets

(56) References Cited

U.S. PATENT DOCUMENTS

| | | | | |
|---|---|---|---|---|
| 10,060,374 | B2 * | 8/2018 | Shen | F02D 41/20 |
| 10,060,399 | B2 * | 8/2018 | Namuduri | F02D 41/20 |
| 10,330,064 | B2 * | 6/2019 | Sakamoto | F02M 59/368 |
| 10,401,398 | B2 * | 9/2019 | Shahroudi | F02D 41/20 |
| 10,557,437 | B2 * | 2/2020 | Iwano | F02D 41/20 |
| 10,677,184 | B2 * | 6/2020 | Kusakabe | F02M 61/1833 |
| 10,712,373 | B2 * | 7/2020 | Shahroudi | G01R 17/00 |
| 10,941,738 | B1 * | 3/2021 | Puckett | F02M 45/04 |
| 11,008,957 | B2 * | 5/2021 | Coldren | F02D 19/0642 |
| 2008/0141957 | A1 * | 6/2008 | Dea | F02D 13/0246 123/90.11 |
| 2015/0377176 | A1 * | 12/2015 | Hatanaka | F02M 51/061 137/554 |
| 2016/0069312 | A1 * | 3/2016 | Brown | H01F 7/1607 239/585.5 |
| 2016/0186707 | A1 * | 6/2016 | Sakamoto | F02M 59/464 417/505 |
| 2016/0237937 | A1 * | 8/2016 | Kusakabe | F02D 41/402 |
| 2016/0319763 | A1 * | 11/2016 | Shen | F02D 41/20 |
| 2018/0171955 | A1 * | 6/2018 | Rezaei | F02M 63/0015 |
| 2018/0252752 | A1 * | 9/2018 | Shahroudi | F02D 41/20 |
| 2018/0328308 | A1 * | 11/2018 | Iwano | F02M 59/366 |
| 2019/0346490 | A1 * | 11/2019 | Shahroudi | F02D 41/248 |
| 2020/0386171 | A1 * | 12/2020 | Coldren | F02D 41/406 |
| 2021/0140386 | A1 * | 5/2021 | Puckett | F02M 63/0015 |
| 2021/0164414 | A1 * | 6/2021 | Oki | F02D 41/20 |
| 2021/0180536 | A1 * | 6/2021 | Girard | F02D 41/26 |

* cited by examiner

METHOD AND SYSTEM FOR MONITORING INJECTOR VALVES

TECHNICAL FIELD

The present disclosure relates generally to systems for internal combustion engines, and more particularly, to methods and systems for valve movement detection in a fuel injector of an internal combustion engine system.

BACKGROUND

Internal combustion engines include electronic controllers that monitor and govern multiple aspects of the operation of the engine, including the timing and quantity of fuel injection. In order to accurately control fuel injection, some engine systems include a controller that monitors the position of multiple electronically-controlled solenoid valves. This monitoring can be performed by analyzing current generated when the valve moves between different positions. However, due to the proximity of these valves, electrical cross-talk can occur. This cross-talk can prevent the controller from monitoring the state of valves, and from adjusting control signals for the fuel injector to compensate for changes in the injector's performance characteristics.

An activation controller for a fuel injector is disclosed in U.S. Pat. No. 10,060,399 (the '399 patent) to Namuduri et al. The controller described in the '399 patent receives feedback signals from the fuel injector, such as flux linkage, voltage, and current. A control module may modify a fuel injector signal for injection events according to this feedback. While the controller and fuel injector described in the '399 patent may be useful in some circumstances, they may be unable to provide useful feedback in injector systems in which two or more electrical components associated with the fuel injector are subject to cross-talk.

The disclosed method and system may solve one or more of the problems set forth above and/or other problems in the art. The scope of the current disclosure, however, is defined by the attached claims, and not by the ability to solve any specific problem.

SUMMARY

In one aspect, a method for controlling a fuel injector of an engine system may include applying a spill valve current to move a spill valve of the fuel injector to a closed position, applying a control valve current to move a control valve of the fuel injector to an injection position, the control valve and the spill valve including components that are in electrical communication with each other, and detecting a timing at which the spill valve returns to an open position based on induced spill valve current. The method may also include detecting a timing at which the control valve returns to a resting position based on induced control valve current, the induced spill valve current and the induced control valve current being included in respective freewheeling currents that at least partially overlap each other, adjusting a spill valve current that is applied during an injection, based on the detected spill valve return timing, and adjusting a control valve current that is applied during the injection, based on the detected control valve return timing.

In another aspect, a method for controlling a fuel injector of an engine system, the fuel injector including a first solenoid-driven valve and a second solenoid-driven valve in electrical communication with the first solenoid-driven valve, the second solenoid-driven valve having a shorter return time from an actuated position to a resting position as compared to the first solenoid-driven valve, may include applying a current to a first solenoid of the first solenoid-driven valve and applying a current to a second solenoid of the second solenoid-driven valve. The method may also include measuring a return timing of at least one of the first solenoid-driven valve or the second solenoid-driven valve and performing a measurement strategy, including one or more of causing a first freewheeling current of the first solenoid-driven valve to begin to increase at approximately a same timing as a second freewheeling current of the second solenoid-driven valve, ignoring a first current peak for the first solenoid-driven valve, or applying a limit to an adjustment to the current that is applied to the first solenoid, the current that is applied to the second solenoid, or both.

In yet another aspect, a fuel injection control system may include at least one power source and a fuel injector, the fuel injector including a spill valve, the spill valve being biased towards an open position and including a spill valve solenoid and a control valve, the control valve being biased towards a resting positon and including a control valve solenoid in electrical communication with the control valve solenoid. The fuel injection control system may also include a controller configured to apply a spill valve current to move a spill valve of the fuel injector to a closed position, apply a control valve current to move a control valve of the fuel injector to an injection position, the control valve and the spill valve including components that are in electrical communication with each other, and detect a timing at which the spill valve returns to an open position. The controller may further be configured to detect a timing at which the control valve returns to a resting position, apply a strategy to allow detection of the spill valve return timing based on an induced spill valve current and the control valve return timing based on an induced control valve current, and adjust at least one of a spill valve current that is applied during an injection or a control valve current that is applied during the injection.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
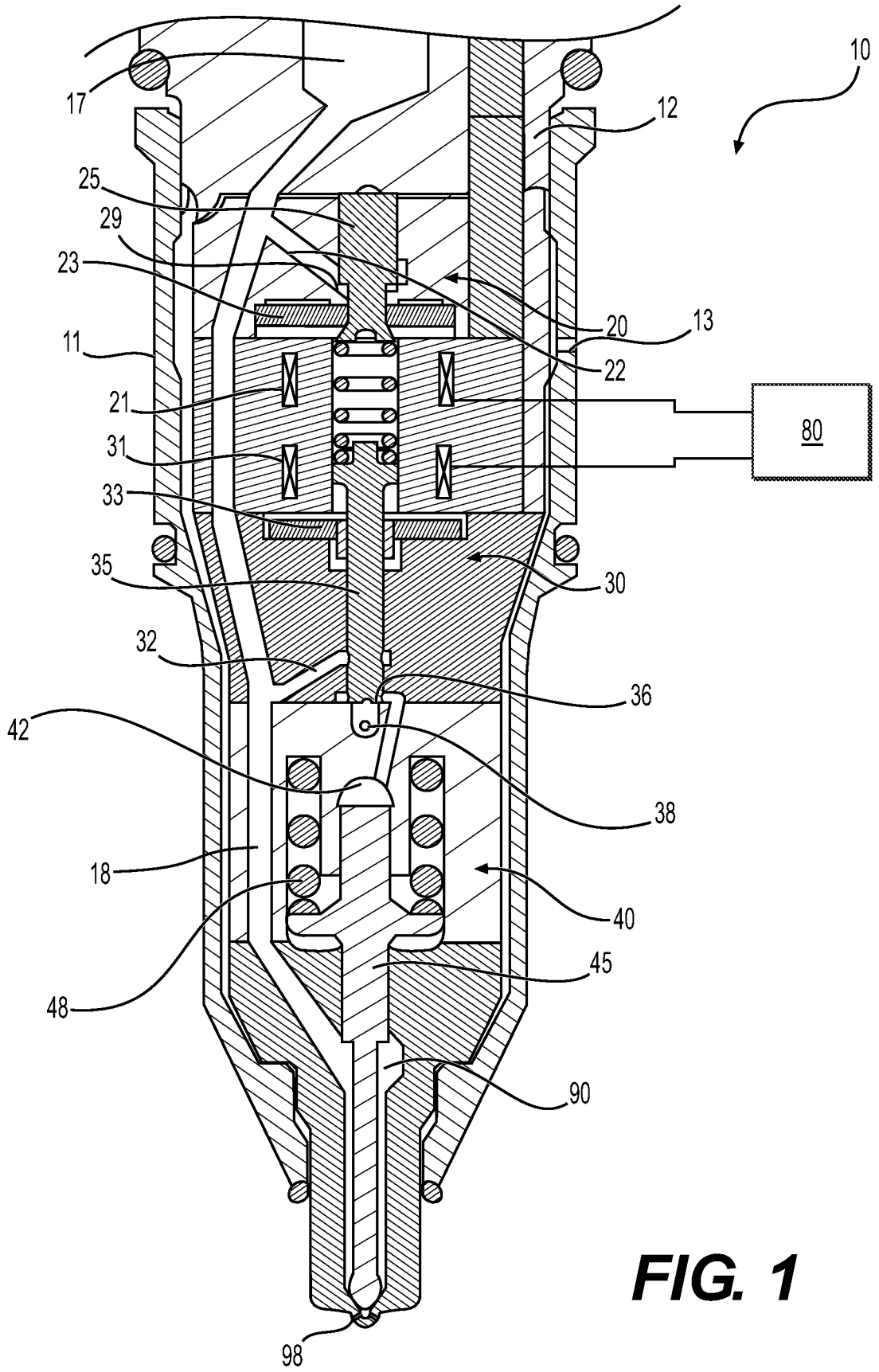
FIG. 1 is a partially schematic cross-sectional view in a fuel injector of a fuel injection system, according to aspects of the present disclosure.

FIG. 1 is a diagram illustrating a fuel injection system 10 according to an aspect of the present disclosure, including a cross-sectional view of a fuel injector 12. Fuel injection system 10 may be a component of an internal combustion engine system and may include a fuel injector 12, one or more power sources, and a controller configured to cause the power sources to provide electrical energy to fuel injector 12, such as an electronic control module (ECM) 80. Fuel injector 12 may be a mechanically-actuated electronically-controlled unit injector including an injector body 11 housing a plurality of electronically-controlled valves that operate in conjunction for injecting fuel. Fuel injector 12 may also include a series of passages for supplying, returning, and injecting fuel. A fuel reservoir or pressure chamber 17 may receive fuel from a fuel source. Fuel within pressure chamber 17 may be pressurized by a cam-actuated piston (not shown) to provide pressurized fuel to a check valve 40. In addition to check valve 40, fuel injector 12 may include one or more electronically-controlled valves, such as a spill valve 20 and a control valve, such as direct-operated control (DOC) valve 30.

Spill valve 20 may be a normally-open valve that includes a spill solenoid 21, spill armature 23, spill valve member 25, and a spill valve seat 29. When spill valve 20 is in a resting or open position (the position illustrated in FIG. 1), a spill valve member 25 may be positioned away from seat 29 to permit communication between a spill passage 22 and a fuel return passage 13, reducing pressure and allowing fuel to drain from injector 12. When actuated or closed, spill valve member 25 may rest on spill valve seat 29 and prevent fuel from entering fuel return passage 13. This actuated position of spill valve 20 may be associated with the injection of fuel.

DOC valve 30 may be a normally-closed valve that includes a DOC solenoid 31, a DOC armature 33, a DOC valve member 35, and a DOC valve seat 36. In a first position of DOC valve 30 illustrated in FIG. 1, referred to as a resting position or a closed position herein, DOC valve member 35 may be positioned so as to permit communication between a control chamber 42 and pressure connection passage 32. When in this closed position, DOC valve member 35 may rest on DOC valve seat 36 and block communication between control chamber 42 and a low-pressure fuel passage pressure connection passage 38, placing control chamber 42 in a pressurized condition that prevents motion of check valve member 45. DOC valve member 35 may be biased toward this closed position by a spring member. In a second position, referred to as an actuated position or an open position herein, DOC valve member 35 may block communication between control chamber 42 and pressure fuel channel 32, and may permit communication between control chamber 42 and low-pressure passage 38, releasing pressure in control chamber 42. The actuated or open position of DOC valve 30 may be associated with the injection of fuel.

Spill solenoid 21 and DOC solenoid 31 may be positioned in proximity to each other, such that these solenoids are electrically coupled to each other. As used herein, the phrases "electrically coupled" and "in electrical communication" refer to components that transfer electrical energy to each other under at least some conditions, so as to create cross-talk. For example, a change in current in one of solenoids 21 and 31 may induce a voltage and generate a measureable current in the other solenoid. Solenoids 21 and 31 may be inductively coupled to each other, for example.

Check valve 40 may be a one-way needle valve including a check valve member 45 that, when in a closed position shown in FIG. 1, blocks communication between a check valve chamber 90 and injection orifices 98. When in an open position, communication may be permitted between check valve chamber 90 and injection orifices 98, allowing fuel to be injected. A spring member 48 may bias check valve member 45 toward the closed position. Additionally, check valve member 45 may be held in the closed position when control chamber 42 is in communication with pressure connection passage 32. Needle valve member 45 may be configured to move from this closed position to an open position when DOC valve 30 is in the open position or actuated position. For example, when spill valve 20 is closed and DOC valve 30 is open, control chamber 42 may be at a lower pressure compared to pressure within check valve chamber 90, thereby allowing pressurized fuel in check valve chamber 90 to act against a biasing force of spring member 48 and inject fuel through orifices 98.

Figure 7:
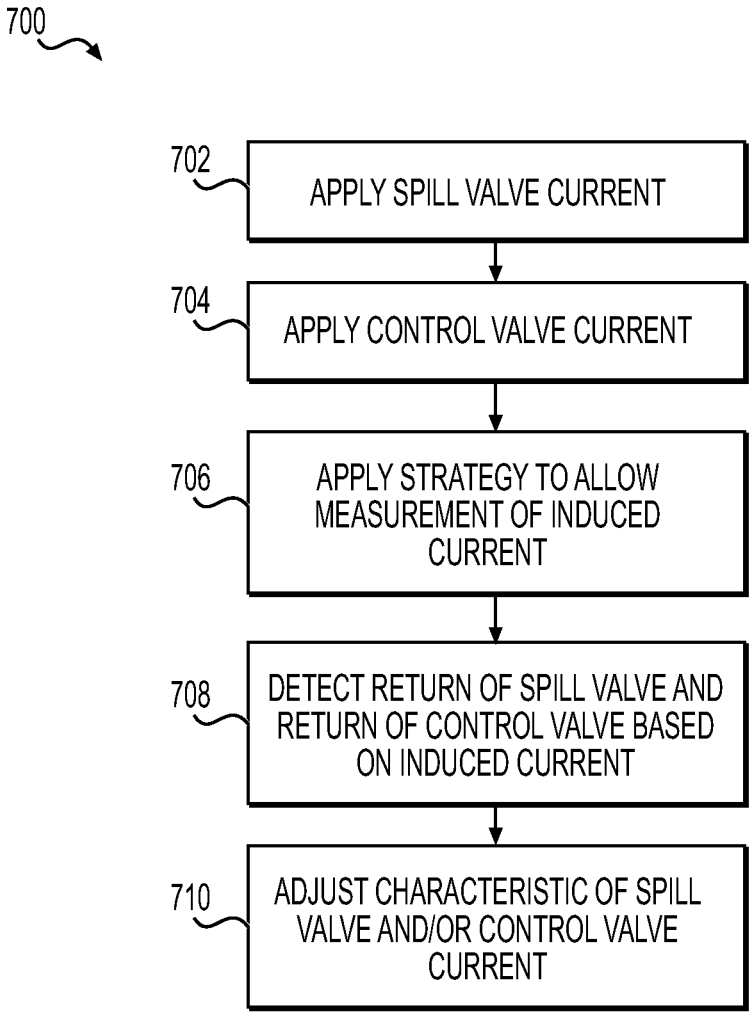
FIG. 7 is a flowchart of a method for controlling a fuel injector of an engine system, according to aspects of the present disclosure.

ECM 80 may be configured to receive sensed inputs and generate commands or other signals to control the operation of a plurality of fuel injectors 12 of fuel injection system 10, each fuel injector 12 including valves 20, 30, and 40. ECM 80 may include a single microprocessor or multiple microprocessors that receive inputs and issue control signals, including the application of electrical energy to solenoids 21 and 31. ECM 80 may contain a power source (e.g., a battery) in electrical communication with solenoids 21 and 31, and may output commands to separate control circuitry, including circuitry for boosting a voltage of electrical energy applied to solenoids 21 and 31. ECM 80 may be configured to control the application of electrical energy, and therefore current, to solenoids 21 and 31. For example, ECM 80 may issue commands to selectively energize solenoids 21 and 31 with electrical power and may control circuitry configured to de-energize solenoids 21 and 31 and control a rate of decay of electrical energy stored by solenoids 21 and 31. ECM 80 may include a memory, a secondary storage device, a processor, such as a central processing unit, or any other means for accomplishing a task consistent with the present disclosure. The memory or secondary storage device associated with ECM 80 may store data and software to allow ECM 80 to perform its functions, including the functions described below with respect to method 700 (FIG. 7). In particular, data and software in memory or secondary storage device(s) may allow ECM 80 to perform any of the valve return timing, signal analyses, and adaptive injector control functions described herein. Numerous commercially available microprocessors can be configured to perform the functions of ECM 80. Various other known circuits may be associated with ECM 80, including signal-conditioning circuitry, communication circuitry, and other appropriate circuitry.

Figure 2:
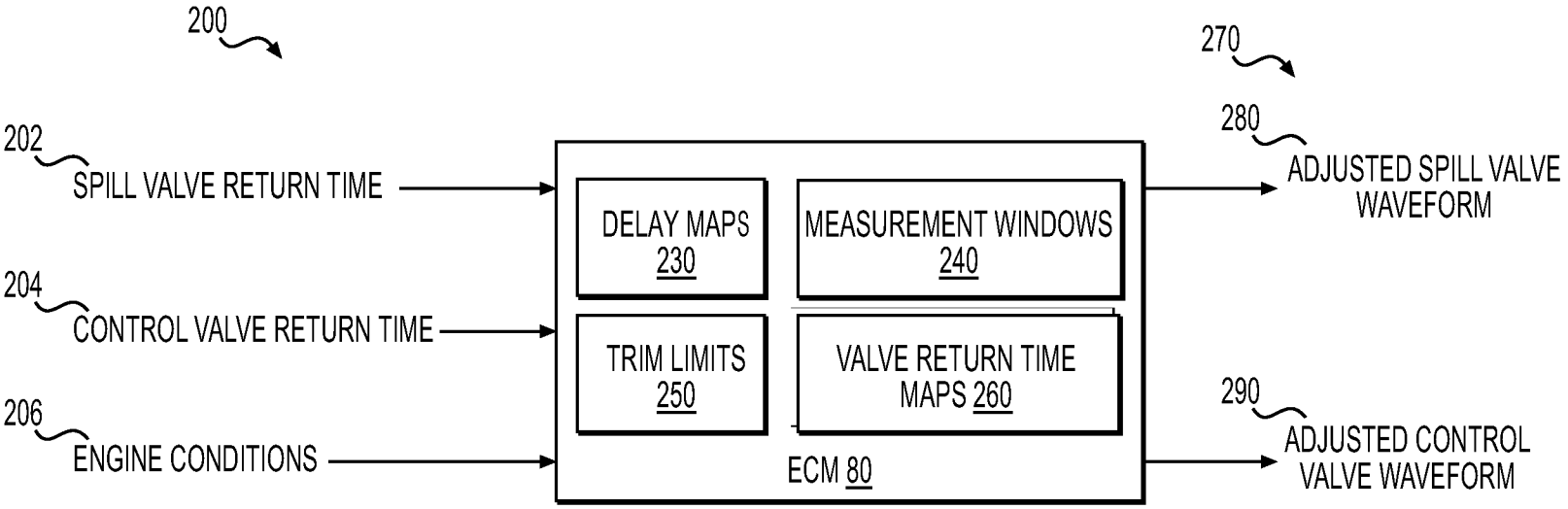
FIG. 2 is a block diagram of an exemplary engine control module of the fuel injection system of FIG. 1.

FIG. 2 illustrates an exemplary configuration of ECM 80. In at least some aspects, ECM 80 may receive inputs 200, including detected values, calculated values, or both. ECM 80 may provide, as outputs 270, one or more adjusted spill valve waveforms 280 and/or adjusted DOC valve waveforms 290. Waveforms 280 and 290 may correspond to control signals generated by ECM 80 to apply electrical energy to solenoids 21 and 31, respectively.

Spill valve return time 202 may be a signal indicative of the timing at which spill valve member 25 returns to a resting position in which spill valve 20 is open. This signal may be generated and identified, for example, near the end of an injection event following a time during which spill valve 20 was closed to facilitate the pressurization and injection of fuel. Control valve return time 204 may be a signal indicative of the timing at which control valve member 35 returns to a resting or closed position after being actuated to inject fuel. Return times 202 and 204 may be analyzed by ECM 80 to determine each return timing by evaluating current levels in solenoid 21 and solenoid 31, as described below. In one aspect, return times 202 and 204 may be measured during a single injection event. For example, return times 202 and 204 may each correspond to the end of an injection, or a time immediately following the injection and before a subsequent injection. Engine conditions 206 may correspond to one or more signals indicative of engine parameters such as engine speed, requested engine output, or other factors upon which ECM 80 may determine a quantity and timing associated with the injection of fuel. Engine conditions 206 may include one or more sensed conditions (e.g., engine speed) and one or more conditions calculated by ECM 80 or another control unit (e.g., a desired quantity of fuel injection).

Outputs 270 may correspond to control signals provided for providing electrical energy to solenoids 21 and 31 to operate spill valve 20 and DOC valve 30. An adjusted spill valve waveform 280 may include control signals for energizing solenoid 21 and positioning spill valve 20 in a closed position for a desired period of time. Adjusted control valve waveform 290 may include control signals for energizing solenoid 31 and positioning DOC valve 30 in an open position for a desired period of time. The control signals of adjusted spill valve waveform 280 and adjusted control valve waveform 290 may be modified based on the detected times 202 and 204. Return times 202 and/or 204 may be identified, via analysis performed by ECM 80, by using at least one delay map 230, measurement window 240, or trim limit 250. Return times 202 and/or 204, once analyzed by ECM 80, may be compared to respective expected return times. An expected valve return time may be determined by retrieving a value from a valve return time map 260, based on current engine conditions 206.

In particular, ECM 80 may include one or more delay maps 230 storing information representative of movement of spill valve 20. Information stored in delay maps 230 may include one or more times at which a valve of injector 12 will begin to return from an actuated position to a resting position, once current is no longer applied to the solenoid associated with the valve. Thus, delay maps 230 may represent the amount of time, or delay, between a first time where current is no longer applied from an energy source, and a second time where freewheeling current is first enabled and monitored. This second time may, in at least some aspects, occur after movement of the valve from the actuated position to the resting position begins. The information stored in delay maps 230 may be based on the expected performance of spill valve 20, DOC valve 30, or both. In particular, delay maps 230 may include information that indicates which valve is expected to return from an actuated position more quickly.

Measurement windows 240 may represent periods of time during which ECM 80 analyzes freewheeling current for the presence of a pattern associated with current induced by the return of spill valve 20 and/or DOC valve 30 to a resting position. Measurement windows 240 may include one or more periods of time during which ECM 80 analyzes current for a pattern indicative of the return the valve. Measurement windows 240 may also include one or more periods of time during which ECM 80 ignores current patterns.

Trim limits 250 may include information corresponding to limits that are imposed on adjustments to the current waveforms for spill valve 20 and/or DOC valve 30. ECM 80 may access trim limits 250 to determine the maximum permissible adjustments that are accomplished via adjusted spill valve waveform 280, adjusted control valve waveform 290, or both. In particular, trim limits 250 may represent a latest time current is permitted to be applied, an earliest time at which current is permitted to be withdrawn, or both.

Valve return time maps 260 may include information indicative of an expected timing at which spill valve member 25 or DOC valve member 35 returns to a resting position after being actuated. A first map 260 may allow ECM 80 to retrieve an expected or desired return time at which spill valve 20 arrives for a set of map inputs, while a second map 260 may allow ECM 80 to retrieve an expected or desired return time for DOC valve 30 for a respective set of map inputs. Inputs to map 260 may include, for example, engine conditions 206, an instantaneous level of current applied to solenoid 21 or 31 when electrical energy is no longer supplied to the solenoid, a cumulative amount of current applied to the solenoid 21 or 31 during at least a part of an injection, or a voltage of a power source that supplies current to solenoid 21 or 31.

INDUSTRIAL APPLICABILITY

Fuel injection system 10 may be used in conjunction with any appropriate machine, vehicle, or other device or system that includes an internal combustion engine having one or more fuel injectors with electronically-controlled valves. In particular, fuel injection system 10 may be used in any internal combustion engine system in which it is desirable to detect a timing at which electronically-controlled valve components reach resting positions after being actuated. Fuel injection system 10 may be useful in systems that include two or more electrically-coupled solenoid-actuated valves and may be configured to detect the return timing of each of these valves in a single fuel injection event.

FIGS. 3-6 are charts of exemplary plots of waveforms, with respect to time, illustrating current within spill solenoid 21 and DOC solenoid 31. ECM 80 may monitor these currents to identify return times of spill valve 20 and DOC valve 30. In particular, ECM 80 may perform pattern analysis on freewheeling currents generated via solenoids 21 and/or 31, to identify peaks in these currents, which may be indicative of timings at which the spill valve 20 and DOC valve 30 return to their respective resting positions. In at least some aspects, the monitored freewheeling spill and control valve currents may at least partially overlap each other (FIGS. 3-6).

Figure 3:
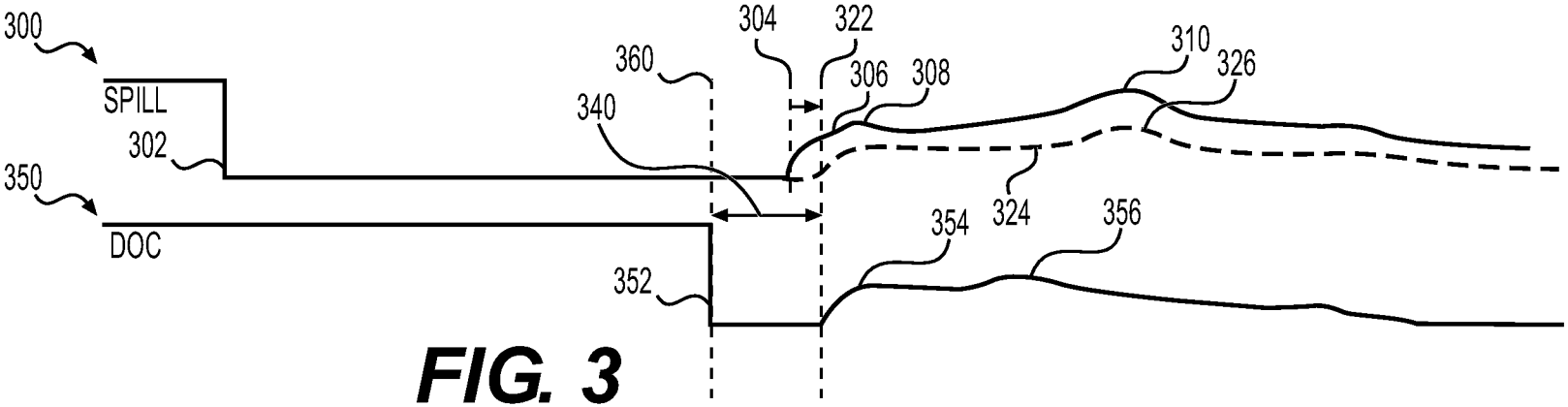
FIG. 3 is a chart illustrating an exemplary operation of the fuel injection system of FIG. 1.

With reference to FIG. 3, spill valve current 300 may be applied to maintain spill valve 20 in the closed position by generating an electromotive force, with spill solenoid 21, on spill armature 23. A DOC valve current 350 may be applied to maintain DOC valve 30 in the open position by applying current to DOC solenoid 31. Spill valve current 300 may be applied until a time that coincides with a current draw down 302. At a later time represented by time 304, a freewheeling state may be enabled to facilitate the detection of freewheeling current 306. This freewheeling current 306 may include an induced current component resulting from motion of spill valve member 25 and armature 23. For example, induced current may be generated by this motion at a time when electromotive force generated by solenoid 21 has dissipated by an amount that allows spill valve member 25 to begin returning from spill valve seat 29 to a resting position.

Current 306 may also include the effect of cross-talk from current 350 applied for DOC valve 30. For example, changes in DOC valve current 350 may introduce noise that increases or decreases the level of freewheeling current 306, while current 306 is monitored by ECM 80. For example, the influence of DOC current waveform 350 may tend to increase current 306 and thereby introduce a first current peak 308 that occurs before the actual time at which spill valve 30 returns to the resting position. As ECM 80 may monitor current 306 for a current peak indicative of the return time of spill valve 30, ECM 80 may correlate peak 308 with this return time, rather than a second current peak 310 which coincides with the actual return time of spill valve 20. Under some conditions, peak 308 may have an amplitude that is approximately the same as, or larger than, peak 310, which may further interfere with the identification of the actual return time of spill valve 20.

DOC valve current 350 may be applied until electrical energy is withdrawn 352 at a withdrawal time 360. Similar to spill valve member 25, DOC valve member 35 may begin to return to a resting position once electromotive force dissipates. As DOC valve member 35 returns to the resting position, this motion may induce current, this induced current contributing to a current 354 that is monitored beginning at time 322. Monitored current 354 may include a current peak 356 that occurs due to current induced when DOC valve member 35 reaches the resting position. Freewheeling current 354 may at least partially overlap freewheeling current 306.

With continued reference to FIG. 3, ECM 80 may, as a first exemplary strategy, adjust the timing for activating a circuit for monitoring spill valve current 300 to reduce the influence of DOC valve current 350 on the induced spill valve current. For example, the time at which spill valve current 300 is monitored by enabling a freewheeling state may be extended to a second or adjusted time 322. As in the illustrated example, the initial rise in freewheeling current may be delayed by an amount of time that causes freewheeling current for the spill valve and DOC valve to begin to rise at approximately the same time, time 322.

The time at which DOC valve current is monitored while in a freewheeling state may begin following a delay 340, which may be employed to determine time 322. A value of delay 340 may be retrieved by querying one or more delay maps 230 based on current engine conditions 206 (FIG. 2). Thus, the timing at which freewheeling is enabled may be the same for the spill and DOC valves, or may be offset by a predetermined amount so as to begin at similar times. This strategy may reduce or eliminate the influence of DOC valve current 350 on spill valve current 300. For example, as represented by dotted lines of spill valve current 300, freewheeling current 324 may be detected by ECM 80, allowing ECM 80 to identify a peak 326 that corresponds to an actual timing at which spill valve 25 returns to a resting position.

Figure 4:
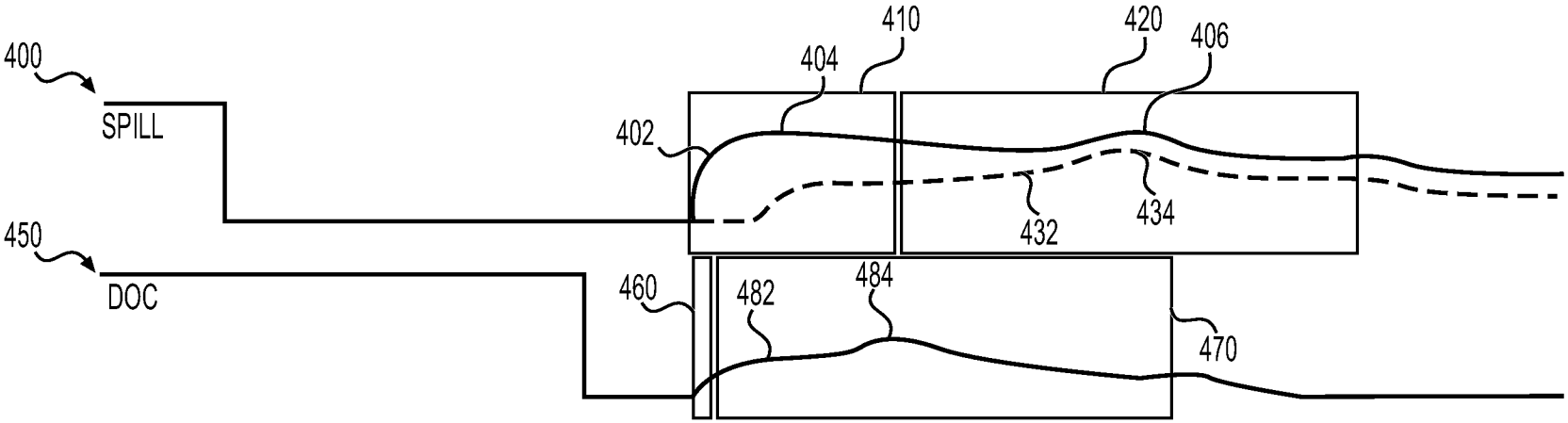
FIG. 4 is a chart illustrating an exemplary operation of the fuel injection system of FIG. 1.

FIG. 4 includes a spill valve current 400 and DOC valve current 450 for actuating and monitoring valves 20 and 30. Spill valve current 400 may include a freewheeling current 402, having peaks 404 and 406, measured by ECM 80 via a freewheeling circuit in communication with spill solenoid 21. This freewheeling current may include a current component introduced by DOC valve current 450. A dotted line portion of spill valve current 400 represents freewheeling current 432 that more closely corresponds to the actual motion of spill valve member 25. Thus, the arrival time of spill valve 25 may result in a current peak 434. The current 402 measured by ECM 80 may be larger than current 432 due to the activation of freewheeling to monitor the induced current, and the influence of cross-talk from DOC valve 30. DOC valve current 450 may include freewheeling current 482 having a peak 484 that corresponds to an arrival time of DOC valve member 35 to a resting position.

ECM 80 may, as a second exemplary strategy for monitoring current associated with spill valve 20, DOC valve 30, or both, apply one or more monitoring windows during which freewheeling current is monitored for a pattern indicative of valve return timing, such as a current peak introduced by induced current. This second strategy may include one or more windows during which patterns, such as current peaks in the freewheeling current, are ignored. ECM 80 may ignore current peaks that occur outside of a monitoring window 420. For example, a peak 404 occurring outside of monitoring window 420, such as during a pre-monitoring window 410, may be ignored. Similarly, during a pre-monitoring window 460 applied for analysis of DOC valve current 450, a peak or other pattern, when present, may be ignored.

Pre-monitoring windows 410 and 460 may be different for different valves of injector 12, as illustrated in FIG. 4. Similarly, monitoring windows 420 and 470 may be different for the different valves of injector 12. In some aspects, the valve that tends to return more quickly (e.g., DOC valve 30) may have a longer monitoring window 470 as compared to the monitoring window 420 to the valve that returns more slowly (e.g., spill valve 20). Information regarding these return times, or delays, may be retrieved from delay maps 230.

If desired, ECM 80 may be configured to modify windows for monitoring induced current for spill valve 20 and/or DOC valve 30. For example, when ECM 80 determines that cross-talk is more likely to occur (e.g., based on engine conditions 206), ECM 80 may decrease a duration of monitoring windows 420 and 470.

Figure 5:
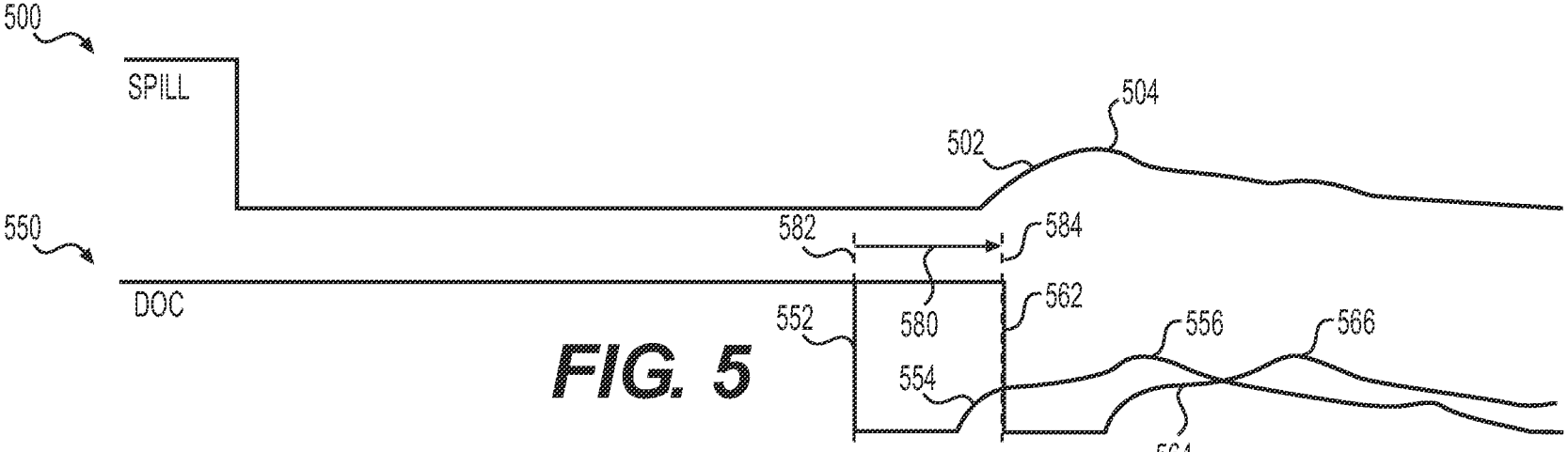
FIG. 5 is a chart illustrating an exemplary operation of the fuel injection system of FIG. 1.

FIG. 5 illustrates exemplary waveforms of spill valve current 500 and DOC valve current 550 applied to actuate and monitor valves 20 and 30. Spill valve current 500 may include a freewheeling current 502 having a peak 504 caused by induced current that corresponds to the return of spill valve member 25. DOC valve current 550 may be applied as an unadjusted DOC valve waveform 552 or an adjusted DOC valve waveform 562. Unadjusted DOC valve waveform 552 may be applied by discontinuing the application of electrical energy to DOC solenoid 31 at an unadjusted time 582. Freewheeling current 554 and in particular, freewheeling current peak 556, may correspond to current induced by the motion of DOC valve 30 when electric energy is withdrawn at time 582.

In order to compensate for changes in performance of DOC valve 30 and/or changing engine conditions 206, ECM 80 may adjust the timing of DOC current 550, resulting in adjusted DOC valve waveform 562. For example, it may be desirable to delay the withdrawal or draw down of energy supplied to DOC solenoid 31 until an adjusted time 584, by continuing to apply electrical energy for a delay 580. This may result in a freewheeling current 564 having a peak 566.

In some aspects, ECM 80 may impose a limit on a maximum amount by which DOC current 550 may be extended or a latest point in time that DOC current 550 may be applied. This limit may, for example, prevent the application of a high level of DOC current 550 at a timing that would overlap peak 504, or prevent application current within a predetermined period of time prior to peak 504. In the example illustrated in FIG. 5, this limit may correspond to time 584. Thus, DOC current 550 may be prevented from interfering with the detection of a current peak 504 caused by induced current included in freewheeling current 502.

Figure 6:
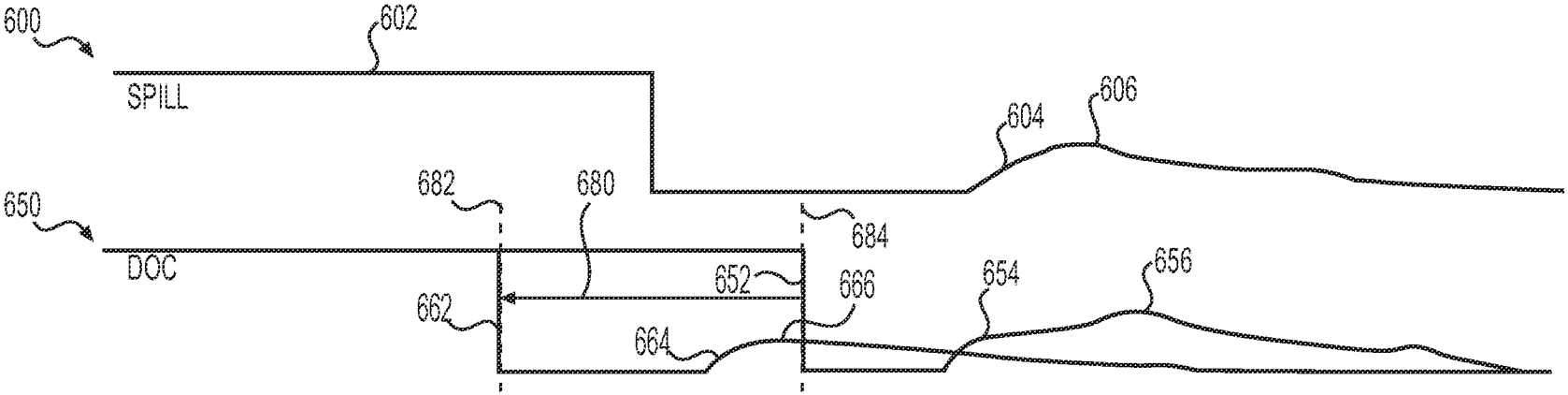
FIG. 6 is a chart illustrating an exemplary operation of the fuel injection system of FIG. 1.

FIG. 6 illustrates exemplary waveforms of spill valve current 600 and DOC valve current 650 according to another example of the third strategy. Spill valve current 600 may include a high current level 602 that is applied for a desired time to hold spill valve 20 closed. Spill valve current 600 may also include an induced current peak 606 included in freewheeling current 604. DOC valve current 650 may be applied as an unadjusted DOC valve waveform 652 or an adjusted DOC valve waveform 662. With reference to unadjusted DOC valve waveform 652, electrical energy may be applied until an unadjusted timing 684. Once electrical energy dissipates following unadjusted timing 684, a return motion of DOC valve member 35 may generate an induced current peak 656 included in freewheeling current 654.

ECM 80 may adjust the timing of DOC current 650, for example, to inject a desired quantity of fuel. For example, ECM 80 may determine that it is necessary to reduce an amount of time an energy source applies current to DOC solenoid 31, for example at by applying adjusted DOC valve waveform 662 in which electrical energy is no longer applied and/or is drawn down at an advanced timing 682. Adjusted DOC valve waveform 662 may result in a freewheeling current 664 having a peak 666.

As part of the third strategy, ECM 80 may impose a limit on a maximum amount by which DOC current 650 may be advanced (e.g., by an advance 680). This limit may, for example, prevent the application of high current level 602 at a timing that would overlap peak 666. Thus, cross-talk or other noise that would prevent detection of peak 666 may be avoided, facilitating the measurement of the valve return timing of DOC valve 30. In the example of FIG. 6, this limit may correspond to time 682.

FIG. 7 is a flowchart illustrating a method 700 for controlling one or more fuel injectors 12 of an engine system which may include fuel injection system 10. Method 700 may be performed repeatedly during the operation of an engine to gradually adjust commands that are issued to one or more valves of injector 12 in order to compensate for changing conditions. Method 700 may, for example, include applying one or more of the above-described strategies to facilitate the detection of return timings for spill valve 20, DOC valve 30, or both, even when freewheeling currents associated with valves 20 and 30 overlap each other with respect to time. Based on the detected return timings, waveforms for the spill valve 20 and/or DOC valve 30 may be adjusted in order to facilitate precise control over injector 12 as performance of one or more valves of injector 12 change, for example due to wear.

In a step 702, current may be applied to solenoid 21 in order to close spill valve 20. Similarly, in a step 704, ECM 80 may control the application of current for opening DOC valve 30. Steps 702 and 704 may include applying current for each valve 20 and 30 until a desired timing.

During a step 706, ECM 80 may apply the first strategy, second strategy, third strategy, or any combination thereof, to facilitate measurement and monitoring of freewheeling current. This freewheeling current may include current induced by the return of the spill valve 20 and current induced by the return of DOC valve 30. The freewheeling currents may be generated at timings that at least partially overlap each other. For example, in a first strategy, the timing at which freewheeling current is monitored in a first valve may be delayed or alternatively, advanced. This may be performed such that this first valve, which may be the valve that returns more slowly (e.g., spill valve 20), will experience an initial increase in freewheeling current at approximately the same time as freewheeling current is enabled for the faster valve (e.g., DOC valve 30). This may, for example, ensure that the dwell times following the application of electrical energy are within acceptable windows for both valves. A second strategy, that may be performed alone or in combination with the first or third strategies, may include the use of one or more pre-monitoring windows and one or more monitoring windows, as described above. A third strategy, which may be performed alone or with the first or second strategies, may include applying one or more limits on an amount by which the current for spill valve 20, DOC valve 30, or both, is adjusted.

A step 708 may include detecting the return timings of spill valve 20 and DOC valve 30, while performing one or more of the strategies applied during step 706. This may prevent cross-talk from interfering with the detection of the valve return timing 202 of spill valve 20 and valve return timing 204 of DOC valve 30. Both valve return times may be detected for a single injection of fuel.

In a step 710, ECM 80 may adjust at least one characteristic of the current applied for closing spill valve 20, opening DOC valve 30, or both. This may be performed, for example, based on the detected spill valve return timing 202 and the detected DOC valve return timing 204. The characteristic of the current may include, for example, a timing at which the application of electrical energy begins, a timing at which the application of electrical energy stops, and/or a duration during which the electrical energy is applied.

In some fuel injectors, it is useful to obtain measurements for two or more valves. The use of one or more strategies may allow for simultaneous valve monitoring, even when components of the valves are electrically coupled. This simultaneous monitoring, which may be performed by detecting valve return times in a single fuel injection, may facilitate accurate evaluation of the actual operation of a fuel injector. By measuring valve return time, it may be possible to adapt the duration during which current is applied during subsequent injections to minimize fuel delivery variability and increase control over the quantity of injected fuel. Increased control over the amount of injected fuel may facilitate the injection of a minimum quantity of fuel, such as a pilot injection performed during a main injection, or a post injection performed after a main injection. Accurate injection of a small amount of fuel may improve emissions performance and reduce the quantity and/or opacity of smoke produced by the engine.

It will be apparent to those skilled in the art that various modifications and variations can be made to the disclosed method and system without departing from the scope of the disclosure. Other embodiments of the method and system will be apparent to those skilled in the art from consideration of the specification and practice of the apparatus and system disclosed herein. It is intended that the specification and examples be considered as exemplary only, with a true scope of the disclosure being indicated by the following claims and their equivalents.

What is claimed is:

1. A method for controlling a fuel injector of an engine system, the method comprising:

applying a spill valve current to move a spill valve of the fuel injector to a closed position;

applying a control valve current to move a control valve of the fuel injector to an injection position, the control valve and the spill valve including components that are in electrical communication with each other;

detecting a timing at which the spill valve returns to an open position based on induced spill valve current;

detecting a timing at which the control valve returns to a resting position based on induced control valve current, the induced spill valve current and the induced control valve current being included in respective freewheeling currents that at least partially overlap each other;

adjusting the spill valve current that is applied during an injection, based on the detected spill valve return timing; and adjusting the control valve current that is applied during the injection, based on the detected control valve return timing.

2. The method of claim 1, further including applying a measurement strategy including one or more of:

causing a first freewheeling current of the spill valve to begin to increase at approximately a same timing as a second freewheeling current of the control valve, ignoring a first current peak for the spill valve or the control valve that occurs outside of a measurement window, or applying a limit to an adjustment to the spill valve current, an adjustment to the control valve current, or both.

3. The method of claim 1, wherein a timing of the induced spill valve current does not overlap a timing the control valve current is applied.

4. The method of claim 3, further including applying a measurement strategy that includes applying the spill valve current and the control valve current such that the freewheeling currents begin at approximately the same time.

5. The method of claim 2, wherein the measurement strategy includes detecting a peak of at least one of the induced spill valve current or the induced control valve current that occurs within a measurement window.

6. The method of claim 5, wherein the measurement strategy includes ignoring a current peak that occurs outside of the measurement window.

7. The method of claim 1, further including applying a measurement strategy that includes limiting an increase or decrease in an amount of time the spill valve current is adjusted.

8. The method of claim 1, further including applying a measurement strategy that includes limiting an increase or decrease in an amount of time the control valve current is adjusted.

9. A method for controlling a fuel injector of an engine system, the fuel injector including a first solenoid-driven valve and a second solenoid-driven valve positioned within a proximity of the first solenoid-driven valve that enables cross-talk between the first solenoid-driven valve and the second solenoid-driven valve, the second solenoid-driven valve having a shorter return time from an actuated position to a resting position as compared to the first solenoid-driven valve, the method comprising:

applying a current to a first solenoid of the first solenoid-driven valve;

applying a current to a second solenoid of the second solenoid-driven valve;

measuring a return timing of at least one of the first solenoid-driven valve or the second solenoid-driven valve; and performing a measurement strategy, including one or more of:

causing a first freewheeling current of the first solenoid-driven valve to begin to increase at approximately a same timing as a second freewheeling current of the second solenoid-driven valve;

ignoring a first current peak for the first solenoid-driven valve; or applying a limit to an adjustment to the current that is applied to the first solenoid, the current that is applied to the second solenoid, or both.

10. The method of claim 9, wherein the measurement strategy includes adjusting the timing at which the current is applied to the first solenoid-driven valve.

11. The method of claim 9, wherein the measurement strategy includes applying a measurement window to measure the return timing of the first solenoid-driven valve and ignoring the first current peak for the first solenoid-driven valve, wherein the ignoring is performed when the first current peak occurs outside of the measurement window.

12. The method of claim 9, wherein the measurement strategy includes detecting a second current peak that occurs within a measurement window.

13. The method of claim 9, wherein the measurement strategy includes applying a limit to the adjustment to the current applied to the second solenoid.

14. The method of claim 13, wherein the measurement strategy includes applying a limit to a latest time that current is applied to the second solenoid.

15. The method of claim 13, wherein the measurement strategy includes applying a limit to an earliest time that current is no longer applied to the second solenoid.

16. The method of claim 9, wherein the return timing of the first solenoid-driven valve and the return timing of the second solenoid-driven valve are measured in a single fuel injection.

17. A fuel injection control system, comprising:

at least one power source;

a fuel injector including:

a spill valve, the spill valve being biased towards an open position and including a spill valve solenoid;

a control valve, the control valve being biased towards a resting positon and including a control valve solenoid in electrical communication with the spill valve solenoid; and a controller configured to:

apply a spill valve current to move the spill valve of the fuel injector to a closed position;

apply a control valve current to move the control valve of the fuel injector to an injection position;

detect a timing at which the spill valve returns to the open position;

detect a timing at which the control valve returns to the resting position;

apply a strategy to allow detection of the spill valve return timing based on an induced spill valve current and the control valve return timing based on an induced control valve current; and adjust at least one of the spill valve current that is applied during an injection or the control valve current that is applied during the injection.

18. The fuel injection control system of claim 17, wherein a timing of the induced spill valve current does not overlap a timing the control valve current is applied.

19. The fuel injection control system of claim 17, wherein the strategy includes detecting a peak of at least one of a freewheeling spill valve current that includes the induced spill valve current or a freewheeling control valve current that includes the induced control valve current that occurs within a measurement window.

20. The fuel injection control system of claim 17, wherein the strategy includes limiting an amount the spill valve current or the control valve current is adjusted.

* * * * *